US007163771B2

(12) United States Patent
Ioannidis et al.

(10) Patent No.: US 7,163,771 B2
(45) **Date of Patent: *Jan. 16, 2007**

(54) IMAGING MEMBERS

(75) Inventors: Andronique Ioannidis, Webster, NY (US); Zoran D. Popovic, Mississauga (CA); Nancy L. Belknap, Rochester, NY (US); John F. Graham, Oakville (CA); Cindy C. Chen, Rochester, NY (US); Peter A. Veneman, Tuscson, AZ (US)

(73) Assignee: Xerox Corporation, Stamford, CT (US)

( * ) Notice: Subject to any disclaimer, the term of this patent is extended or adjusted under 35 U.S.C. 154(b) by 315 days.

This patent is subject to a terminal disclaimer.

(21) Appl. No.: 10/879,679

(22) Filed: Jun. 29, 2004

(65) Prior Publication Data

US 2005/0287453 A1 Dec. 29, 2005

(51) Int. Cl.
*G03G 5/047* (2006.01)

(52) U.S. Cl. ..... 430/58.15; 430/58.25; 430/58.5; 430/58.8; 430/59.4

(58) Field of Classification Search ..... 430/58.15, 430/58.05, 58.25, 58.8, 58.5, 59.4
See application file for complete search history.

(56) References Cited

U.S. PATENT DOCUMENTS

| | | | | |
|---|---|---|---|---|
| 4,555,463 | A | 11/1985 | Hor et al. | 430/59 |
| 4,587,189 | A | 5/1986 | Hor et al. | 430/59 |
| 4,921,769 | A | 5/1990 | Yuh et al. | 430/64 |
| 5,336,577 | A | 8/1994 | Spiewak et al. | 430/59 |
| 5,473,064 | A | 12/1995 | Mayo et al. | 540/141 |
| 5,493,016 | A | 2/1996 | Burt et al. | 540/139 |
| 5,645,965 | A | 7/1997 | Duff et al. | 430/59 |
| 5,756,245 | A | 5/1998 | Esteghamatian et al. | 430/59 |
| 6,156,468 | A | 12/2000 | Wehelie et al. | 430/65 |
| 6,177,219 | B1 | 1/2001 | Yuh et al. | 430/65 |
| 6,255,027 | B1 | 7/2001 | Wehelie et al. | 430/65 |
| 6,586,148 | B1 * | 7/2003 | Graham et al. | 430/58.65 |
| 6,890,693 | B1 * | 5/2005 | Zhu et al. | 430/58.45 |
| 2004/0009418 | A1 * | 1/2004 | Main et al. | 430/58.75 |

OTHER PUBLICATIONS

James M. Duff et al., Imaging Members Having a Single Electrophotographic Photoconductive Insulating Layer, U.S. Appl. No. 09/627,283, filed Jul. 28, 2000.

Nancy L. Belknap et al., Photodoncutive Imaging Members, U.S. Appl. No. 10/408,201, filed Apr. 4, 2003.

* cited by examiner

*Primary Examiner*—John L Goodrow
(74) *Attorney, Agent, or Firm*—E. O. Palazzo

(57) ABSTRACT

A photoconductive member containing a supporting substrate; a photogenerating layer comprised of a photogenerating component, a hole transport component, an electron transport component, and a polymer binder; and a charge transport layer comprised of a charge transport component, an electron transport component and a polymer binder.

45 Claims, No Drawings

IMAGING MEMBERS

CROSS-REFERENCE TO RELATED APPLICATIONS AND PATENTS

Illustrated in copending application U.S. Ser. No. 10/879,426, Publication No. 20050287454, entitled Imaging Members, the disclosure of which is totally incorporated herein by reference, is a photoconductive member comprised of a supporting substrate, a photogenerating layer, and a charge transport layer and wherein the photogenerating layer comprises a photogonerating component, and an electron transport component, and wherein the electron transport component is selected from the group consisting of a carbonylfluorenone malononitrile of the formula

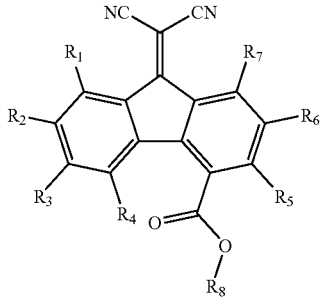

wherein each R is independently selected from the group consisting of hydrogen, alkyl, alkoxy, aryl, and halide; a nitrated fluorenone of the formula

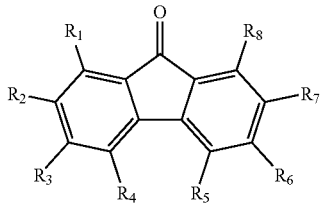

wherein each R is independently selected from the group consisting of alkyl, alkoxy, aryl, and halide, and wherein at least two R groups are nitro; a diimide selected from the group consisting of N,N'-bis(dialkyl)-1 ,4,5,8-naphthalenetetracarboxylic diimide and N,N'-bis(diaryl)-1,4,5,8-naphthalenetetracarboxylic diimide represented by the formula

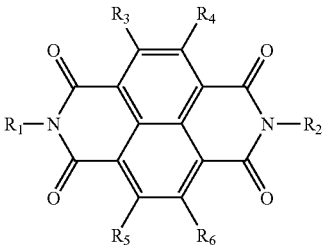

wherein $R_1$ is alkyl, alkoxy, cycloalkyl, halide, or aryl; $R_2$ is alkyl, alkoxy, cyoloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

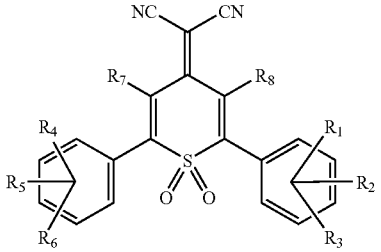

wherein each R is independently selected from the group consisting of hydrogen, alkyl, alkoxy, aryl, and halide; a carboxybenzylnaphthaquinone of the alternative formulas

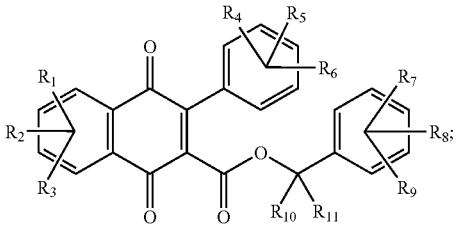

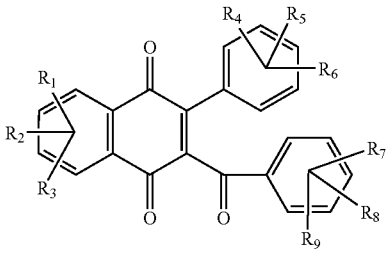

wherein each R is independently selected from the group consisting of hydrogen, alkyl, alkoxy, aryl, and halide; and a diphenoquinone of the formula

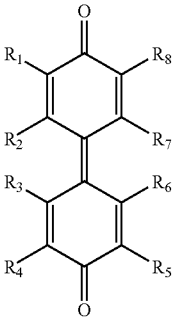

wherein each R is independently selected from the group consisting of hydrogen, alkyl, alkoxy, aryl, and halide.

Illustrated in U.S. Pat. No. 6,853,369, the disclosure of which is totally incorporated herein by reference, is, for example, a photoconductive imaging member comprised of a supporting substrate, and thereover a single layer comprised of a mixture of a photogenerator component, a charge transport component, an electron transport component, and a polymer binder, and wherein the photogenerating component is, for example, a metal free phthalocyanine.

Illustrated in copending application U.S. Ser. No. 10/225,402, filed Aug. 20, 2002, Publication No. 20040038140, now abandoned, on Benzophenone Bisimide Malononitrile Derivatives, the disclosure of which is totally incorporated herein by reference, is, for example, a compound having the Formula I

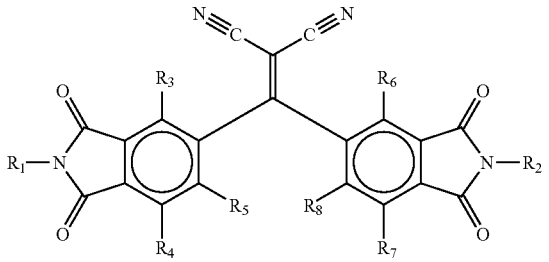

wherein $R_1$ and $R_2$ are independently selected from the group consisting of hydrogen, a heteroatom containing group and a hydrocarbon group that is optionally substituted at least once with a heteroatom moiety; and $R_3$, $R_4$, $R_5$, $R_6$, $R_7$, and $R_8$ are independently selected from the group consisting of a nitrogen containing group, a sulfur containing group, a hydroxyl group, a silicon containing group, hydrogen, a halogen, a heteroatom containing group and a hydrocarbon group that is optionally substituted at least once with a heteroatom moiety.

Illustrated in copending application U.S. Ser. No. 10/144,147, filed May 10, 2002, Publication No. 20030211413, now abandoned, entitled Imaging Members, the disclosure of which is totally incorporated herein by reference, is, for example, a photoconductive imaging member comprised of a supporting substrate, and thereover a single layer comprised of a mixture of a photogenerator component, a charge transport component, an electron transport component, and a polymer binder, and wherein the photogenerating component can be a metal free phthalocyanine.

Illustrated in copending application U.S. Ser. No. 09/302,524, filed on Apr. 30, 1999, now abandoned, entitled Photoconductive Members, the disclosure of which is totally incorporated herein by reference, is, for example, an ambipolar photoconductive imaging member comprised of a supporting substrate, and thereover a layer comprised of a photogenerator hydroxygallium component, a charge transport component, and an electron transport component.

Illustrated in copending application U.S. Ser. No. 09/627,283, filed Jul. 28, 2000, now abandoned, entitled Imaging Members Having a Single Electrophotographic Photoconductive Insulating Layer, the disclosure of which is totally incorporated herein by reference, is, for example, an imaging member comprising a member comprising a supporting layer and a single electrophotographic photoconductive insulating layer, the electrophotographic photoconductive insulating layer comprising particles comprising Type V hydroxygallium phthalocyanine dispersed in a matrix comprising an arylamine hole transporter, and an electron transporter selected from the group consisting of N,N'-bis(1,2-dimethylpropyl)-1,4,5,8-naphthalenetetracarboxylic diimide represented by the following structural formula:

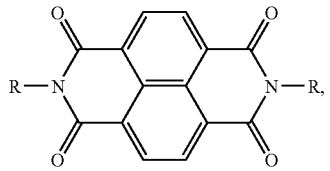

1,1'-dioxo-2-(4-methylphenyl)-6-phenyl-4-(dicyanomethylidene)thiopyran represented by the following structural formula

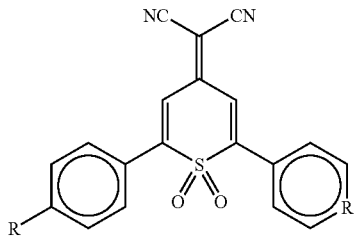

wherein each R is independently selected from the group consisting of hydrogen, alkyl with 1 to 4 carbon atoms, with 1 to 4 carbon atoms and halogen, and a quinone selected from the group consisting of carboxybenzylhaphthaquinone represented by the following structural formula

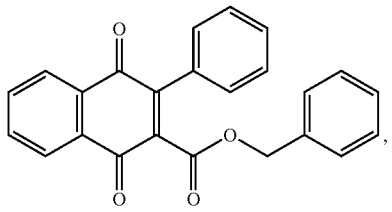

tetra(t-butyl) diphenoquinone represented by the following structural formula

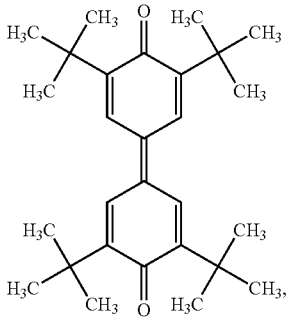

and mixtures thereof, and a film forming binder.

Illustrated in U.S. Pat. No. 444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

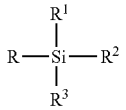

(II)

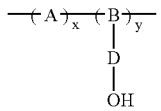

wherein R is alkyl or aryl, $R^1$, $R^2$, and $R^3$ are independently selected from the group consisting of alkoxy, aryloxy, acyloxy, halide, cyano, and amino; A and B are respectively divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in U.S. Pat. No. 6,875,548, the disclosure of which is totally incorporated herein by reference, a photoconductive imaging member comprised of an optional supporting substrate, a photogenerating layer, and a charge transport layer, and wherein said charge transport layer is comprised of a charge transport component and a polysiloxane.

There is illustrated U.S. Pat. No. 6,824,940, the disclosure of which is totally incorporated herein by reference, a photoconductive imaging member containing a hole blocking layer, a photogenerating layer, a charge transport layer, and thereover an overcoat layer comprised of a polymer with a low dielectric constant and charge transport molecules.

There is also illustrated in copending U.S. Ser. No. 10/780,056, Publication No. 20050266326, entitled Electrophotographic Imaging Members, filed Feb. 17, 2004, the disclosure of which is totally incorporated herein by reference, a photoreceptor comprising a top durable layer that is charge generating and/or charge transporting; and a bottom layer that is bipolar charge transporting or bipolar charge generating, wherein the photoreceptor has a negative charging mode of operation.

The appropriate components and processes of the above copending applications may be selected for the invention of the present application in embodiments thereof.

BACKGROUND

This invention relates in general to electrophotographic imaging members and, more specifically, to positively and negatively charged electrophotographic imaging members that are ambipolar or bipolar, and wherein the imaging members contain at least two of photogenerating and charge transport layers and processes for forming images on the member. More specifically, the present invention relates to a photoconductive imaging member containing a charge generation layer or photogenerating layer comprised, for example, of a photogenerating component, a charge transport component, and an electron transport component, and a second charge transport layer comprised of a charge, especially hole transport component, an electron transport component and binder. In embodiments the weight ratio of the charge transport/electron transport in the charge transport layer is preferably, for example, 3:2. Also, in embodiments there can be selected thick photogenerating layers, for example, of 8 or more microns, and more specifically, from about 5 to about 18 microns, and wherein the amount of photogenerating component can be decreased to, for example, 5 weight percent or less.

In embodiments of the present invention there are provided photoconductive imaging members comprised of a photogenerating layer of a metal free phthalocyanine component dispersed in a matrix of a resin binder, hole transporting (HT) and an electron transporting (ET) component in certain ratio amounts in, for example, ratio amounts of HT:ET from about 5:1 to about 1:2, and yet more specifically, in, for example, ratio amounts of about 4:1 to about 3:2, and thereover as a second or top layer a charge, especially hole transport layer comprised of a hole transport molecule electron transport molecules (ET), and a resin binder HT:ET range of about 5:1 to about 1:2, yet more specifically about 4:1 to about 3:2. The electrophotographic imaging member layer components, which can be dispersed in various suitable resin binders, can be of various thickness, however, in embodiments a thick layer, such as from about 5 to about 60, and more specifically from about 8 to about 12 microns, is selected for the photogenerating layer and for the charge transport layer the thickness thereof is, for example, from about 10 to about 50, and more specifically from about 10 to about 20, and yet more specifically about 10 microns. This member can be considered a dual function layer since it can generate charge and transports charge and electrons over a wide distance, such as a distance of at least about 50 microns. Also, the presence of the electron transport components in the photogenerating layer can enhance electron mobility and thus enable a thicker photogenerating layer, and which thick layers can be more easily coated than a thin layer, such as about 1 to 2 microns thick. Furthermore, there is provided in accordance with embodiments of the present invention linear and proportional filed dependent organic photoreceptors, and which members enable, for example, excellent image quality, substantially constant photoinduced discharge characteristics (PIDC) and thus minimal or substantially no variation in image quality; stable photoreceptors resulting, for example, from the use of photogenerating layers that possess linear and proportional field dependent collection efficiencies (CE); and prolonged photoreceptor wear properties.

A number of electrophotographic imaging members are multi-layered imaging members comprising a substrate and a plurality of other layers such as a charge generating layer and a charge transport layer. These multilayered imaging members also often contain a charge blocking layer and an adhesive layer between the substrate and the charge generating layer. "Plywooding" refers, for example, to the formation of unwanted patterns in electrostatic latent images caused by multiple reflections during laser exposure of a charged imaging member. When developed, these patterns resemble plywood. The multi-layered imaging members can be costly and time consuming to fabricate because of the many layers that are formed. Further, complex equipment and valuable factory floor space are usually needed to manufacture multi-layered imaging members. In addition to presenting plywooding problems, the multi-layered imaging members often encounter charge spreading which degrades image resolution.

Another problem that may be encountered with some multilayered photoreceptors comprising a charge generating layer and a charge transport layer is that the thickness of the charge transport layer, which is normally the outermost layer, tends to become thinner due to wear during image cycling. The change in thickness causes changes in the photoelectrical properties of the photoreceptor. Thus, to maintain image quality, complex and sophisticated electronic equipment and software management are usually necessary in the imaging machine to compensate for the photoelectrical changes, which can increase the complexity of the machine, cost of the machine, size of the footprint occupied by the machine, and the like. Without proper compensation of the changing electrical properties of the photoreceptor during cycling, the quality of the images formed can degrade because of spreading of the charge pattern on the surface of the imaging member and a decline in image resolution. High quality images can be important for digital copiers, duplicators, printers, and facsimile machines, particularly laser exposure machines that demand high resolution images. Moreover, the use of lasers to expose conventional multilayered photoreceptors can lead to the formation of undesirable plywood patterns that are visible in the final images.

There have been attempts to fabricate electrophotographic imaging members comprising a substrate and a single electrophotographic photoconductive insulating layer in place of a plurality of layers such as a charge generating layer and a charge transport layer. However, in formulating single electrophotographic photoconductive insulating layer photoreceptors several problems may need to be addressed including charge acceptance for hole and/or electron transporting materials from photoelectroactive pigments. In addition to electrical compatibility and performance, a material mix for forming a single layer photoreceptor should possess the proper rheology and resistance to agglomeration to enable acceptable coatings. Also, compatibility among pigment, hole and electron transport molecules, and film forming binder is desirable.

REFERENCES

Disclosed in U.S. Pat. No. 5,645,965, the disclosure of which is totally incorporated herein by reference, are photoconductive imaging members comprised of a symmetrical dimeric perylene as a charge generator, wherein said perylene is of the formulas illustrated in this patent. The perylene charge transport molecules and other appropriate components of this patent may be selected for the imaging members of the present invention in embodiments thereof.

Illustrated in U.S. Pat. No. 5,756,245, the disclosure of which is totally incorporated herein by reference, is a photoconductive imaging member comprised of a hydroxygallium phthalocyanine photogenerator layer, a charge transport layer, a barrier layer, a photogenerator layer comprised of a mixture of bisbenzimidazo(2,1-a-1',2'-b)anthra (2,1,9-def:6,5,10-d'e'f')diisoquinoline-6,11-dione and bisbenzimidazo (2,1-a:2',1'-a)anthra(2,1,9-def:6,5,10-d'e'f') diisoquinoline-10,21-dione, and thereover a charge transport layer.

Illustrated in U.S. Pat. No. 5,493,016, the disclosure of which is totally incorporated herein by reference, is a process for the preparation of alkoxy-bridged metallophthalocyanine dimers by the reaction of a gallium alkoxide with ortho-phthalodinitrile or 1,3-diiminoisoindoline in the presence of a diol.

Also, in U.S. Pat. No. 5,473,064, the disclosure of which is totally incorporated herein by reference, there is illustrated a process for the preparation of hydroxygallium phthalocyanine consisting essentially of the hydrolysis of halogallium phthalocyanine precursor to a hydrogallium phthalocyanine, and conversion of said resulting hydroxygallium phthalocyanine to Type V hydroxygallium phthalocyanine by contacting said resulting hydroxygallium phthalocyanine with the organic solvent N,N-dimethylformamide, pyridine, dimethylsulfoxide, quinoline, 1-chloronaphthalene, N-methylpyrrolidone, or mixtures thereof, and wherein said hydroxygallium phthalocyanine Type V contains halide in an amount of from about 0.001 percent to about 0.1 percent; and wherein said precursor halogallium phthalocyanine is obtained by the reaction of gallium halide with diiminoisoindoline in an organic solvent.

U.S. Pat. No. 4,265,990, the disclosure of which is totally incorporated herein by reference, illustrates a photosensitive member having at least two electrically operative layers. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula.

U.S. Pat. No. 5,336,577, the disclosure of which is totally incorporated herein by reference, an ambipolar photoresponsive device comprising a supporting substrate; a single organic layer on said substrate for both charge generation and charge transport, for forming a latent image from a positive or negative charge source, such that said layer transports either electrons or holes to form said latent image depending upon the charge of said charge source, said layer comprising a photoresponsive pigment or dye, a hole transporting small molecule or polymer and an electron transporting material, said electron transporting material comprising a fluorenylidene malonitrile derivative; and said hole transporting polymer comprising a dihydroxy tetraphenyl benzidine containing polymer.

The uses of a number of pigments in the photogenerating layer perylene pigments as photoconductive substances is known. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine, dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

SUMMARY

It is, therefore, a feature of the present invention to provide electrophotographic bipolar imaging members with a number of the advantages illustrated herein.

It is another feature of the present invention to provide an electrophotographic imaging member comprised of a dual layer of a photogenerating layer and a charge transport layer, and wherein the photogenerating layer can contain a photogenerating pigment, a charge transport component and an optional electron transport component, and wherein the charge transport layer contains charge transport molecules, electron transport components and a resin binder, and which layers contain, in certain ratios by weight, a photogenerating pigment, an electron transport component, a hole transport component, and a film forming binder; and wherein in embodiments the photogenerating pigment is distributed throughout the photogenerating layer thereby avoiding or minimizing substrate injection; a decrease in charge deficient spots (CDS) print defects; plywood supression; improved compatibility between each layer; the selection of thin charge transport layers of, for example, from about 20 to about 40 microns, and thicker photogenerating layers, for example about 8 microns or greater, and negatively charging members.

It is still another feature of the present invention to provide improved electrophotographic imaging members that eliminate the need for a charge blocking layer between a supporting substrate and an electrophotographic photoconductive insulating layer, and wherein the photogenerating mixture layer can be of a thickness of, for example, from about 5 to about 60 microns, and thereover as the top layer a charge transporting layer, and which members possess excellent high photosensitivities, acceptable discharge characteristics, prolonged wear characteristics, and further which members are visible and infrared laser compatible.

It is yet another feature of the present invention to provide an electrophotographic imaging member which can be fabricated with fewer coating steps at reduced cost.

It is another feature of the present invention to provide an electrophotographic imaging member comprising a charge transport layer which reduces charge spreading, therefore, enabling higher resolution, and which member is not substantially susceptible to plywooding effects, a light refraction problem, and thus with the photoconductive imaging members of the present invention in embodiments thereof an undercoated separate layer is avoided.

It is yet another feature of the present invention to provide electrophotographic imaging members with improved cycling stability, and which members possess high resolution since, for example, the image forming charge packet does not need to traverse the entire thickness of the member and thus does not spread in area, and further with such layered members there are enabled in embodiments extended life high resolution members since, for example, the layer can be present in a thicker, such as from about 5 to about 60 microns, layer as compared to a number of multilayered devices wherein the thickness of the photogenerator layer is usually about 1 to about 3 microns in thickness, thus with the aforementioned invention devices there is substantially no image resolution loss and substantially no image resolution loss with wear.

It is yet another feature of the present invention to provide an improved electrophotographic imaging member with PIDC curves that do not substantially change with time or repeated use, and also wherein with these photoreceptors charge injections from the substrate to the photogenerating pigment are eliminated or reduced, and thus a charge blocking layer can be avoided.

It is still another feature of the present invention to provide an improved electrophotographic imaging member which is ambipolar and can be operated at either positive or negative biases.

Another feature of the present invention is to provide imaging members with single pigment tunable sensitivity.

Aspects of the present invention are directed to a photoconductive imaging member comprised of a substrate, an electrophotographic photoconductive insulating layer, the electrophotographic photoconductive insulating layer comprising photogenerating particles comprising photogenerating pigments, such as metal free phthalocyanines, charge, such as a hole, transport component or components, an electron transport component or components, and a film forming binder, and thereover a charge transport layer comprised of charge transport components and electron transport components dispersed in a polymeric binder, and wherein the charge transport components can be selected from the group consisting of an arylamine and a hydrazone, and wherein the electron transport material is, for example, selected from the group consisting of BCFM, which is N,N'-bis(1,2-dimethylpropyl)-1,4,5,8-naphthalenetetracarboxylic diimide represented by the following formula

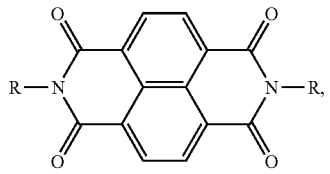

1,1'-dioxo-2-(4-methylphenyl)-6-phenyl-4-(dicyanomethylidene)thiopyran represented by the following formula

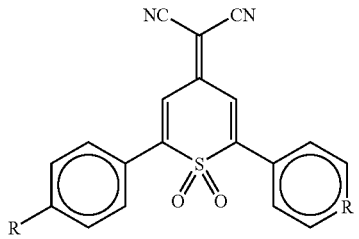

wherein R and R are independently selected from the group consisting of hydrogen, alkyl having 1 to 4 carbon atoms, alkoxy having 1 to 4 carbon atoms and halogen, and an optional quinone selected, for example, from the group consisting of carboxybenzylnaphthaquinone represented by the following formula

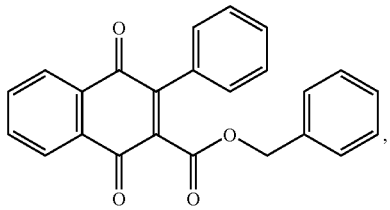

and tetra(t-butyl) diphenolquinone represented by the following formula

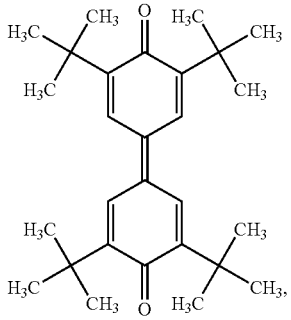

and mixtures thereof, and a film forming binder, for example, selected from the group consisting of polycarbonates, polyesters, polystyrenes, and the like.

This imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

EMBODIMENTS

Further, aspects of the present invention relate to a photoconductive member comprised of a supporting substrate; a photogenerating layer comprised of a photogenerating component, a hole transport component, an electron transport component, and a polymer binder; and a charge transport layer comprised of a charge transport component, an electron transport component and a polymer binder; a photoconductive member comprised of a supporting substrate; a photogenerating layer comprised of a photogenerating component, a hole transport component, an electron transport component, and a polymer binder; and a charge transport layer comprised of a charge transport component, an electron transport component and a polymer binder; a photoconductive imaging member comprised of a supporting substrate; a photogenerating layer comprised of a photogenerating component, a charge transport component, an electron transport component, and a polymer binder; and a charge transport layer comprised of a charge transport component, an electron transport component and a polymer binder; and wherein the electron transport is a carbonylfluorenone malononitrile of the formula

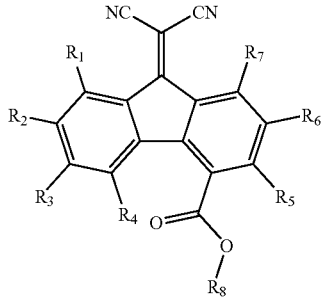

wherein each R is independently selected from the group consisting of hydrogen, alkyl, alkoxy, aryl, and halide; a nitrated fluorenone of the formula

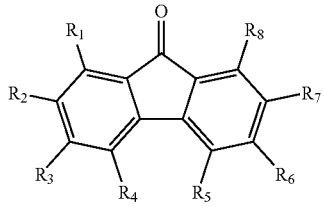

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

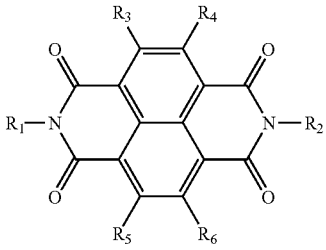

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

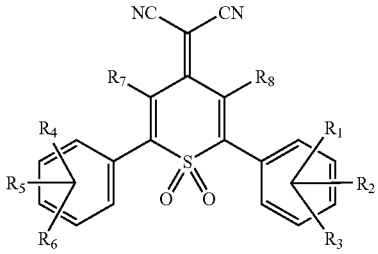

wherein each R is independently selected from the group consisting of hydrogen, alkyl, alkoxy, aryl, and halide; a carboxybenzylnaphthaquinone of the alternative formulas

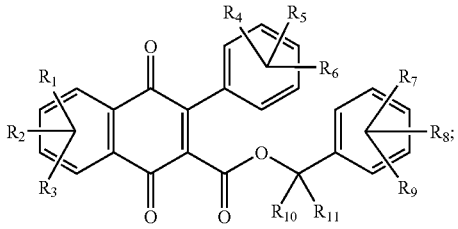

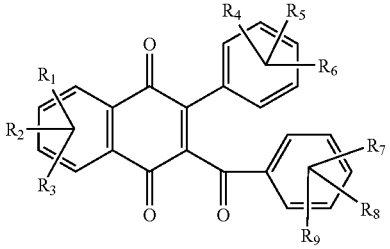

wherein each R is independently selected from the group consisting of hydrogen, alkyl, alkoxy, aryl, and halide; and a diphenoquinone of the formula

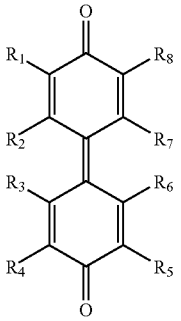

wherein each R is independently selected from the group consisting of hydrogen, alkyl, alkoxy, aryl, and halide; a photoconductive member comprised of a photogenerating layer comprised of a photogenerating component, a hole transport component, and a polymer binder; and a charge transport layer comprised of a charge transport component and a polymer binder; a photoconductive imaging member comprised of photogenerating layer comprised of a photogenerating pigment or mixture of pigments, a hole transport component or components, an electron transport component or components, and a film forming binder, and thereover a hole transport layer comprised of charge transport components and electron transport components dispersed in a polymeric binder; a member wherein the photogenerating layer is of a thickness of, for example, from about 7 to about 12 microns; a member wherein the amounts for each of the components in the photogenerating layer is from about 0.05 weight percent to about 30 weight percent for the photogenerating component, from about 10 weight percent to about 75 weight percent for the hole transport component, and from about 10 weight percent to about 75 weight percent for the electron transport component, and wherein the total of the components is about 100 percent, and wherein the aforementioned layer components are dispersed in from about 10 weight percent to about 75 weight percent of a polymer binder; a member wherein the amounts for each of the photogenerating layer components is from about 0.5 weight percent to about 5 weight percent for the photogenerating component; from about 30 weight percent to about 50 weight percent for the charge transport component; and from about 5 weight percent to about 30 weight percent for the electron transport component; and which components are contained in from about 30 weight percent to about 50 weight percent of a polymer binder; a member wherein the thickness of the photogenerating layer mixture is from about 8 to about 12 microns; a member wherein the components are contained in a polymer binder and wherein the charge transport layer is comprised of hole transport molecules; a member wherein the binder is present in an amount of from about 30 to about 90 percent by weight and wherein the total of all components of photogenerating component, the hole transport component, the binder, and the electron transport component is about 100 percent; a member wherein the metal free phthalocyanine absorbs light of a wavelength of from about 550 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the binder for the photogenerating mixture layer and for the top charge transport layer is selected from the group consisting of polyesters, polyvinyl butyrals, polycarbonates, polystyrene-b-polyvinyl pyridine, amines, such as N,N'-diphenyl-N,N'-bis(alkylphenyl)-1,1-biphenyl-4,4'-diamine; tri-p-tolylamine; N,N'-bis-(3,4,-dimethylphenyl)-4-biphenyl amine; N,N'-bis-(4-methylphenyl)-N,N''-bis(4-ethylphenyl)-1,1'-3,3'-dimethylbiphenyl)-4,4'-diamine; PHN, phenanthrene diamine; polyvinyl formulas; and the like; an imaging member wherein the hole transport for both the photogenerating mixture and for the charge transport layer comprises aryl amine molecules; an imaging member wherein the hole transporting molecules for the photogenerating and charge transport layers are comprised of

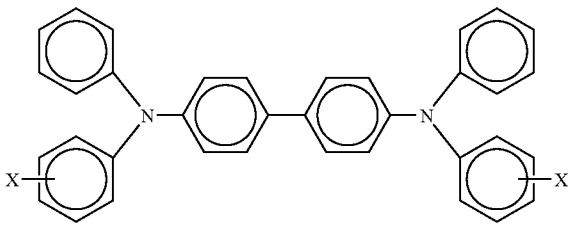

wherein X is selected from the group consisting of alkyl and halogen; an imaging member wherein alkyl contains from about 1 to about 10 carbon atoms; an imaging member wherein alkyl contains from 1 to about 5 carbon atoms; an imaging member wherein alkyl is methyl, and wherein halogen is chloride; an imaging member wherein the charge transport is comprised of N,N'-diphenyl-N,N-bis(3-methyl phenyl)-1,1'-biphenyl-4,4'-diamine dispersed in a resin binder; an imaging member wherein the electron transport component is (4-n-butoxycarbonyl-9-fluorenylidene)malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone; an imaging member wherein the electron transport component is (4-n-butoxycarbonyl-9-fluorenylidene)malononitrile; an imaging member wherein the electron transport component is (4-n-butoxycarbonyl-9-fluorenylidene) malononitrile, 2-methylthioethyl 9-dicyanomethylenefluorene-4-carboxylate, 2-(3-thienyl) ethyl 9-dicyanomethylene fluorene-4-carboxylate, 2-phenylthioethyl 9-dicyanomethylenefluorene-4-carboxylate, 11,11,12,12-tetracyanoanthraquino dimethane or 1,3-dimethyl-10-(dicyanomethylene)-anthrone; an imaging member wherein the photogenerating component is a metal free phthalocyanine; an imaging member wherein the photogenerating component is a metal free phthalocyanine; the electron transport is (4-n-butoxy carbonyl-9-fluorenylidene) malononitrile, and the charge transport is a hole transport of N,N'-diphenyl-N,N-bis(3-methyl phenyl)-1,1'-biphenyl-4,4'-diamine molecules; an imaging member wherein the X polymorph metal free phthalocyanine has major peaks, as measured with an X-ray diffractometer, at Bragg angles (2 theta+/−0.2°); an imaging member wherein the photogenerating component mixture layer further contains a second photogenerating pigment; an imaging member wherein the photogenerating mixture layer further contains a perylene; an imaging member wherein the photogenerating component is comprised of a mixture of a metal free phthalocyanine, and a second photogenerating pigment; a method of imaging which comprises generating an electrostatic latent image on the imaging member of the present invention, developing the latent image, and transferring the developed electrostatic image to a suitable substrate; a method of imaging wherein the imaging member is exposed to light of a wavelength of from about 500 to about 950 nanometers; an imaging apparatus containing a charging component, a development component, a transfer component, and a fixing component, and wherein the apparatus contains a photoconductive imaging member comprised of a supporting substrate, and thereover a photogenerating layer comprised of a metal free phthalocyanine photogenerator component, a charge transport component, and an electron transport component; a member wherein the electron transport is (4-n-butoxycarbonyl-9-fluorenylidene)malononitrile, 2-methylthioethyl 9-dicyano methylenefluorene-4-carboxylate, 2-(3-thienyl)ethyl 9-dicyano methylenefluorene-4-carboxylate, 2-phenylthioethyl 9-dicyano methylenefluorene-4-carboxylate, 11,11,12,12-tetracyano anthraquino dimethane or 1,3-dimethyl-10-(dicyanomethylene)-anthrone, and the like; an imaging member further containing an adhesive layer and a hole blocking layer; an imaging member wherein the blocking layer is contained as a coating on a substrate, and wherein the adhesive layer is coated on the blocking layer; and photoconductive imaging members comprised of an optional supporting substrate, a photogenerating layer comprised of a photogenerating layer of a metal free phthalocyanine, and further BZP perylene, which BZP is preferably comprised of a mixture of bisbenzimidazo(2,1-a-1',2'-b) anthra(2,1,9-def:6,5,10-d'e'f')diisoquinoline-6,11-dione and bisbenzimidazo(2,1-a:2',1'-a)anthra(2,1,9-def:6,5,10-d'e'f') diisoquinoline-10,21-dione, reference U.S. Pat. No. 4,587,189, the disclosure of which is totally incorporated herein by reference, charge transport molecules, reference for example, U.S. Pat. No. 4,265,990, the disclosure of which is totally incorporated herein by reference, electron transport components, and a binder polymer. Preferably the charge transport molecules for the photogenerating mixture layer are aryl amines, and the electron transport is a fluorenylidene, such as (4-n-butoxycarbonyl-9-fluorenylidene) malononitrile, reference U.S. Pat. No. 4,474,865, the disclosure of which is totally incorporated herein by reference.

The positively charged, or negatively charged photoresponsive imaging members of the present invention are embodiments comprised, in the following sequence, of a supporting substrate, may include a hole or electron blocking layer, a photogenerating layer thereover comprised of a photogenerator layer comprised of a metal free phthalocyanine, charge transport molecules of N,N'-diphenyl-N,N'-bis (3-methyl phenyl)-1,1'-biphenyl-4,4'-diamine, and electron transport components of (4-n-butoxycarbonyl-9-fluorenylidene) malononitrile all dispersed in a suitable polymer binder, such as a polycarbonate binder, like PCZ 400, a bisphenol-Z-carbonate with an $M_w$ of about 400, and thereover a charge transport comprised of hole transport molecules and electron transport components dispersed in a resin binder, wherein the weight ratio of photogenerating component/binder/charge transport component/electron transport component is, for example, from about 45:30:20 to about 5:42:35:18, and yet more specifically, about 1.4:48.6:32:18.

Various suitable substrates may be employed in the imaging member of this invention. The substrate may be opaque or substantially transparent, and may comprise any suitable material having the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium and the like, or exclusively be comprised of a conductive material such as aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer. Examples of substrate layers selected for the imaging members of the present invention can be as indicated herein, such as an opaque or substantially transparent material, and may comprise any suitable material having the requisite mechanical properties. Thus, the substrate may comprise a layer of insulating material including inorganic or organic polymeric materials, such as MYLAR® a commercially available polymer, MYLAR® containing titanium, or other suitable metal, a layer of an organic or inorganic material having a semiconductive surface layer, such as indium tin oxide, or aluminum arranged thereon, or a conductive material inclusive of aluminum, chromium, nickel, brass or the like. The thickness of the substrate layer as indicated herein depends on many factors, including economical considerations, thus this layer may be of substantial thickness, for example over 3,000 microns, or of a minimum thickness. In one embodiment, the thickness of this layer is from about 75 microns to about 300 microns.

The binder resin present in various suitable amounts, for example from about 5 to about 70, and more specifically, from about 10 to about 50 weight percent, may be selected from a number of known polymers such as polycarbonates, poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select as the layer coating solvents, such as ketones, alcohols, aromatic hydrocarbons, halogenated aliphatic hydrocarbons, ethers, amines, amides, esters, and the like. Specific binder examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

An optional adhesive layer may be formed on the substrate. Typical materials employed in an undercoat adhesive layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometer to about 10 micrometers. A thickness of from about 0.1 micrometer to about 3 micrometers can be desirable. Optionally, the undercoat layer may contain suitable amounts of additives, for example of from about 1 weight percent to about 10 weight percent, of conductive or nonconductive particles, such as zinc oxide, titanium dioxide, silicon nitride, carbon black, and the like, to enhance, for example, electrical and optical properties. The undercoat layer can be coated on to a supporting substrate from a suitable solvent. Typical solvents include, for example, tetrahydrofuran, dichloromethane, and the like, and mixtures thereof.

Examples of photogenerating components, especially pigments, are metal free phthalocyanines, metal phthalocyanines, titanyl phthalocyanines, perylenes, vanadyl phthalocyanine, chloroindium phthalocyanine, and benzimidazole perylenes, such as BZP, a mixture of, for example, 60/40, 50/50, 40/60, bisbenzimidazo(2,1-a-1',2'-b)anthra(2,1,9-def:6,5,10-d'e'f') diisoquinoline-6,11-dione and bisbenzimidazo (2,1-a:2',1'-a)anthra(2,1,9-def:6,5,10-d'e'f') diisoquinoline-10,21-dione, and the like, inclusive of appropriate known photogenerating components.

Hole transport components that may be selected for the photogenerating mixture and/or the charge transport mixture layer include, for example, arylamines, and more specifically, N,N'-diphenyl-N,N-bis(3-methyl phenyl)-1,1'-biphenyl-4,4'-diamine, 9-9-bis(2-cyanoethyl)-2,7-bis(phenyl-m-tolylamino)fluorene, tritolylamine, hydrazone, N,N'-bis(3,4 dimethylphenyl)-N"(1-biphenyl)amine and the like, dispersed in a polycarbonate binder. This component is present, for example, in an amount of from about 10 percent weight percent solids to about 50 percent weight percent solids, and more specifically, from about 20 percent weight percent solids to about 35 percent weight percent solids, and wherein the charge transport layer is, for example, of a thickness as illustrated herein, from about 10 microns to about 30 microns.

Specific examples of electron transport molecules that can be present in both the photogenerating and charge transport layers, in amounts, respectively, of from about 10 percent weight percent solids to about 50 percent weight percent solids, and more specifically, from about −10 percent weight percent solids to about −30 percent weight percent solids are, for example, (4-n-butoxycarbonyl-9-fluorenylidene) malononitrile, 2-methylthioethyl 9-dicyano methylenefluorene-4-carboxylate, 2-(3-thienyl)ethyl 9-dicyano methylenefluorene-4-carboxylate, 2-phenylthioethyl 9-dicyano methylenefluorene-4-carboxylate, 11,11,12,12-tetracyano anthraquino dimethane, 1,3-dimethyl-10-(dicyanomethylene)-anthrone, and the like.

The photogenerating pigment can be present in various amounts, such as, for example, from about 0.05 weight percent to about 30 weight percent, and more specifically, from about 0.05 weight percent to about 5 weight percent. Charge transport components, such as hole transport molecules, can be present in the charge transport layer in various effective amounts, such as in an amount of from about 10 weight percent to about 75 weight percent and preferably in an amount of from about 30 weight percent to about 50 weight percent; the electron transport components can be present in various amounts, such as in an amount of from about 10 weight percent to about 75 weight percent, and more specifically, in an amount of from about 5 weight percent to about 30 weight percent, and the polymer binder can be present in an amount of from about 10 weight percent to about 75 weight percent, and more specifically, in an amount of from about 30 weight percent to about 50 weight percent.

The photogenerating pigment primarily functions to absorb the incident radiation and generates electrons and holes. In a negatively charged imaging member, holes are transported to the photoconductive surface to neutralize negative charge and electrons are transported to the substrate to permit photodischarge. In a positively charged imaging member, electrons are transported to the surface where they neutralize the positive charges and holes are transported to the substrate to enable photodischarge. By selecting the appropriate amounts of charge and electron transport molecules, ambipolar transport can be obtained, that is, the imaging member can be charged negatively or positively, and the member can also be photodischarged.

The photoconductive imaging members can be prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating, electron transport, and charge transport components and layers of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow.

Imaging members of the present invention are useful in various electrostatographic imaging and printing systems, particularly those conventionally known as xerographic processes. Specifically, the imaging members of the present invention are useful in xerographic imaging processes wherein the photogenerating component absorbs light of a wavelength of from about 550 to about 950 nanometers, and preferably from about 700 to about 850 nanometers. Moreover, the imaging members of the present invention can be selected for electronic printing processes with gallium arsenide diode lasers, light emitting diode (LED) arrays which typically function at wavelengths of from about 660 to about 830 nanometers, and for color systems inclusive of color printers, such as those in communication with a computer. Thus, included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example by heat, the image thereto. In those environments wherein the member is to be used in a printing mode, the imaging method is similar with the exception that the exposure step can be accomplished with a laser device or image bar.

Examples of electron transport components are, for example, a carbonylfluorenone malononitrile of the formula

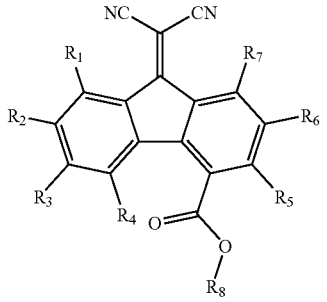

wherein each R is independently selected from the group consisting of hydrogen, alkyl, alkoxy, aryl, and halide; a nitrated fluorenone of the formula

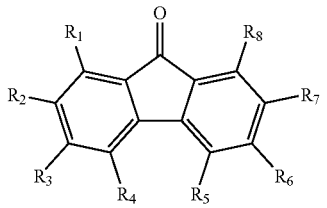

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

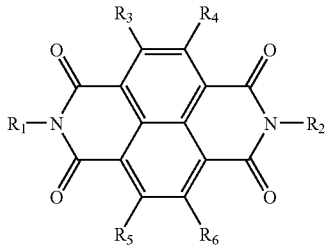

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

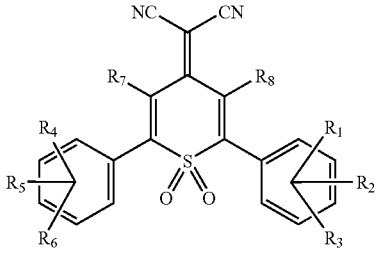

wherein each R is independently selected from the group consisting of hydrogen, alkyl, alkoxy, aryl, and halide; a carboxybenzylnaphthaquinone of the alternative formulas

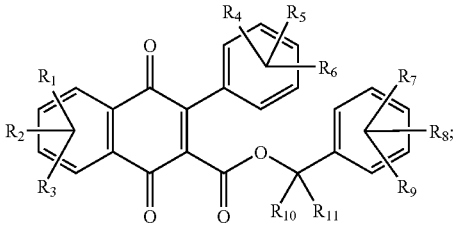

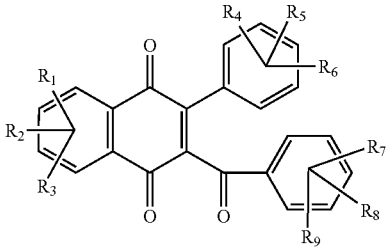

wherein each R is independently selected from the group consisting of hydrogen, alkyl, alkoxy, aryl, and halide; and a diphenoquinone of the formula

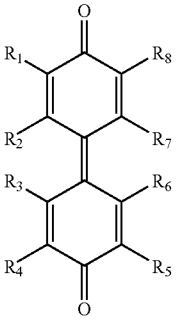

wherein each R is independently selected from the group consisting of hydrogen, alkyl, alkoxy, aryl, and halide.

The electron transport component is, more specifically, a tetra(t-butyl) diphenolquinone represented by the following formula

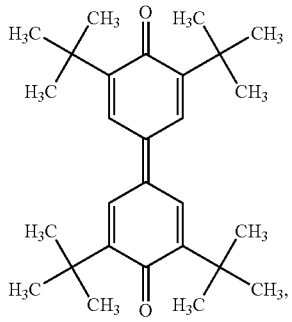

and mixtures thereof, and (4-n-butoxycarbonyl-9-fluorenylidene)malononitrile of the following formulas

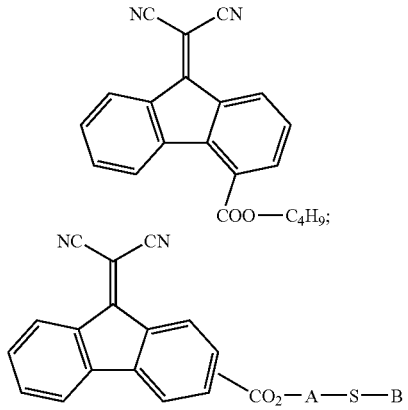

wherein S is sulfur, A is a spacer moiety or group selected from the group consisting of alkylene groups, wherein alkylene can contain, for example, from about 1 to about 14 carbon atoms, and arylene groups, which can contain from about 7 to about 36 carbon atoms, and B is selected from the group consisting of alkyl groups and aryl groups. Specific examples include 2-methylthioethyl 9-dicyanomethylenefluorene-4-carboxylate, 2-(3-thienyl)ethyl 9-dicyano methylenefluorene-4-carboxylate, a 2-phenylthioethyl 9-dicyano methylenefluorene-4-carboxylate, and the like. The electron transporting materials can contribute to the ambipolar properties of the final photoreceptor and also provide the desired rheology and freedom from agglomeration during the preparation and application of the coating dispersion. Moreover, these electron transporting materials ensure substantial discharge of the photoreceptor during imagewise exposure to form the electrostatic latent image.

Polymer binder examples include components as illustrated, for example, in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000, and more specifically, with a molecular weight, $M_w$ of from about 50,000 to about 100,000.

The following Examples are provided.

The XRPDs were determined as indicated herein, that is X-ray powder diffraction traces (XRPDs) were generated on a Philips X-Ray Powder Diffractometer Model 1710 using X-radiation of CuK-alpha wavelength (0.1542 nanometer).

EXAMPLE I

A pigment dispersion was prepared using the known thermally activated dispersion (TAD) process by heating 5 grams of the x polymorph metal free phthalocyanine pigment particles and 5 grams of poly(4,4'-diphenyl-1,1'-cyclohexane carbonate) (PcZ-500, binder available Teijin Chemical, Ltd.) in 66.5 grams of tetrahydrofuran (THF) solvent for about 1 to about 12 hours to form a charge generating solution of metal free phthalocyanine and PcZ-500 in a 1:1 weight ratio in THF solvent.

An ambipolar charge transport layer was prepared by dissolving 6.30 grams of tri-p-tolylamine, 4.20 grams of N,N'-bis(1,2-dimethylpropyl)-1,4,5,8-naphthalenetetracarboxylic diimide, 4.50 grams of PcZ-500 in 50 grams of THF solvent. This mixture was rolled in a glass bottle until the solids were dissolved to form the ambipolar charge transport coating solution containing tri-p-tolylamine, N,N'-bis(1,2-dimethylpropyl)-1,4,5,8-naphthalenetetracarboxylic diimide, PcZ-500 in a solids weight ratio of (42:28:30) and a total solid content of 23 weight percent in THF solvent.

A hole blocking undercoat layer (UCL) was prepared by the slow addition of 26.68 grams of polyvinyl butyral to 540 grams of n-butyl alcohol solvent with vigorous agitation to avoid clumping and ensure complete dissolution of the polyvinyl butyral in the n-butyl alcohol solvent. Then, 381.57 grams of zirconium acetylacetonate tributoxide were slowly added with moderate agitation, and finally 51.66 grams of γ-amino propyl triethoxy silane were added with slow stirring for 16 to 24 hours. The resulting 46 weight percent solid UCL coating solution containing polyvinyl butyral, zirconium acetylacetonate tributoxide and γ-amino propyl triethoxy silane having a 6:83:11 solid weight ratio in n-butyl alcohol was left stagnant for 24 hours then filtered through a 40 micron filter before coating. The solution was applied using a dip coating method to aluminum drums having a length of about 24 to about 36 centimeters, and a diameter of 30 millimeters. The device was preheated to 59° C. and 54 percent humidity for 17 minutes then dried for 8.5 minutes at 135° C. to form the resulting 1.15 micrometer hole blocking layer containing polyvinyl butyral, zirconium acetylacetonate tributoxide and γ-amino propyl triethoxy silane having a 6:83:11 solid weight ratio.

The charge generator dispersion (CGL) was applied by a ring coating method on top of the hole blocking layer, and wherein the charge generation layer (CGL) was of a thickness of about 0.2 to about 1 micron. Subsequently, the ambipolar transport layer was applied directly over the CGL by the Tsukiage coating method to form an ambipolar charge transport layer of about 10 to about 12 microns, dry thickness, as determined by capacitive measurement. The fully formed device was oven dried for 40 minutes at 120° C.

The resulting member was comprised of a 12 micrometer ambipolar charge transport layer containing tri-p-tolylamine, N,N'-bis(1,2-dimethylpropyl)-1,4,5,8-naphthalenetetracarboxylic diimide, PcZ-500 in a solids weight ratio of (42:28:30), formed on a 0.2 micrometer charge generating layer containing metal free phthalocyanine and PcZ-500 in a 1:1 solids weight ratio, formed on a 1.5 micrometer 3-component hole blocking layer on a honed aluminum substrate.

EXAMPLE II

The above device and similar devices were electrically tested with a cyclic scanner set to obtain 100 charge-erase cycles wherein the applied charge was incrementally increased with cycling to produce a charge density plot to determine capacitive charging characteristics. This test was immediately followed by an additional 100 cycles, sequences at 2 charge-erase cycles and 1 charge-expose-erase cycle, wherein the light intensity was incrementally increased with cycling to produce a photoinduced discharge curve from which the photosensitivity was measured. Finally, constant current was applied for a single cycle, and in the absence of light, the device was monitored for 5 cycles or 14 seconds to measure the dark discharge current. The scanner was equipped with a single wire corotron (5 centimeters wide) set to deposit 100 nanocoulombs/$cm^2$ of charge on the surface of the drum devices. The device of Example I was first tested in the negative charging mode and then in the positive charging mode. The exposure light intensity was incrementally increased by means of regulating a series of neutral density filters, and the exposure wavelength was controlled by a band filter at 780+ or −5nanometers. The exposure light source was 1,000 watt Xenon arc lamp white light source.

The drum was rotated at a speed of 20 rpm to produce a surface speed of 8.3 inches/second or a cycle time of three seconds. The entire xerographic simulation was carried out in an environmentally controlled light tight chamber at ambient conditions (35 percent RH and 20° C.).

The device described in Example I was tested using the above processes. The device exhibited equivalent linear charging characteristics in both positive and negative charging modes, demonstrating the ambipolar functionality of the charge transport layer. Dark discharge in both charging modes also showed nearly equivalent behavior with a dark discharge of 3 V/s in positive mode and 5 V/s in negative mode with a slight advantage of lower dark discharge in electron transport mode (positive charging). Both hole and electron transport modes showed similar sensitivities (dV/dx), calculated from the initial discharge rate at low exposure intensity, at about 78 to about 79 V/ergs/$cm^2$.

The above member containing an ambipolar transport matrix containing tri-p-tolylamine and N,N'-bis(1,2-dimethylpropyl)-1,4,5,8-naphthalenetetracarboxylic diimide indicated an advantage in electron-transport mode (positive charging) in that dark decay and charging were improved versus hole-transport mode (negative charging).

EXAMPLE III

A pigment dispersion was prepared by roll milling 6.3 grams of Type V hydroxygallium phthalocyanine pigment particles and 6.3 grams of poly(4,4'-diphenyl-1,1'-cyclohexane carbonate) binder (PcZ-200, available from Teijin Chemical, Ltd.) in 107.4 grams of tetrahydrofuran (THF) solvent with several hundred, about 700 to 800 grams, of 3 millimeter diameter steel or yttrium zirconium balls for about 2 to about 72 hours. The dispersion millbase was diluted to 5.6 solid weight percent using the appropriate amount of THF solvent.

Separately, 0.63 gram of poly(4,4'-diphenyl-1,1'-cyclohexane carbonate) was weighed along with 1.09 gram of tri-p-tolylamine, 0.73 gram of N,N'-bis(1,2-dimethylpropyl)-1,4,5,8-naphthalenetetracarboxylic diimide, 8.69 grams of THF solvent and 2.58 grams of monochlorobenzene (MCB) solvent. This mixture was rolled in a glass bottle until the solids were dissolved then 6.28 grams of the above pigment dispersion were added to form the ambipolar charge generator coating solution containing the Type V hydroxygallium phthalocyanine pigment, poly(4,4'-diphenyl-1,1'-cyclohexane carbonate), tri-p-tolylamine, and N,N'-bis(1,2-dimethylpropyl)-1,4,5,8-naphthalene tetracarboxylic diimide in a solids weight ratio of (5:30:39:26) and a total solid content of 14 weight percent in an 85:15 weight ratio of THF:MCB solvent; and rolled to mix (without milling beads).

Separately, an ambipolar charge transport coating solution was prepared by dissolving 19.32 grams of tri-p-tolylamine, 12.88 grams of N,N'-bis(1,2-dimethylpropyl)-1,4,5,8-naphthalenetetracarboxylic diimide, 13.80 grams of PcZ-500 in 130.9 grams of THF solvent and 23.15 grams of monochlorobenzene (MCB) solvent. This mixture was rolled in a glass bottle until the solids were dissolved to form the ambipolar charge transport coating solution containing tri-p-tolylamine, N,N'-bis(1,2-dimethylpropyl)-1,4,5,8-naphthalenetetracarboxylic diimide, PcZ-500 in a solids weight ratio of (42:28:30) and a total solid content of 23 weight percent in an 85:15 weight ratio of THF:MCB solvent.

The ambipolar charge generator dispersion was applied by a ring coating method directly to a bare aluminum substrate having a length of about 24 to about 36 centimeters and a diameter of 30 millimeters. For the 14 solid weight percent dispersion, a pull rate of about 400 millimeters/minute provided an approximately 4.5 micrometer thick ambipolar charge generator layer, as determined by capacitive measurement after air drying ten minutes in ambient conditions.

Subsequently, the ambipolar transport solution was applied directly over the ambipolar charge generator layer by a ring coating method to form the ambipolar charge transport layer. The fully formed device was oven dried for 40 minutes at 120° C.

Thickness of the resulting dried layers was determined by capacitive measurement and transmission electron spectroscopy. The thick, ambipolar charge generation layer swelled to about 8 micrometers after the 12 micrometer ambipolar charge transport layer was applied.

The resulting member was comprised of a 12 micrometer ambipolar charge transport layer containing tri-p-tolylamine, N,N'-bis(1,2-dimethylpropyl)-1,4,5,8-naphthalenetetracarboxylic diimide, PCZ-500 in a solids weight ratio of (42:28:30) formed over an 8 micrometer ambipolar charge generating layer containing Type V hydroxygallium phthalocyanine pigment, poly(4,4'-diphenyl-1,1'-cyclohexane carbonate), tri-p-tolylamine, and N,N'-bis(1,2-dimethylpropyl)-1,4,5,8-naphthalene tetracarboxylic diimide in a solids weight ratio of (5:30:39:26) formed directly on an aluminum substrate.

EXAMPLE IV

The processes of Example II were repeated except that the device in Example III was tested. As illustrated, the device exhibited similar photoinduced discharge characteristics in both positive and negative charging modes, demonstrating the dual charging mode functionality of the ambipolar charge transport matrix represented here in both the transport and thick generation layers. Hole and electron transport modes showed sensitivities (dV/dx), calculated from the initial discharge rate at low exposure intensity, at about 474 and 380 V/ergs/$cm^2$, respectively.

The thick, ambipolar CGL coated on a bare aluminum drum substrate exceeded expectations for transport, note the high sensitivity of 474 V/erg/cm$^2$ (for the device total thickness of about 20 microns), sharp discharge and low residual (50 V) which indicated that electron transport was not limited at the CGL thickness (nor of course was hole transport limited across either layer). There was also no evidence of substrate injection in negative mode (the charging potentials were nearly coincident at different times on 5 probes).

For the charge transport layer on this thick charge generation layer, since in negative charging mode the truly ambipolar character of the transport layer was not needed, therefore, the electron transport molecule was present in order to avoid admixing issues with the CGL on coating.

For electron transport throughout both layers, the PIDC still showed quite high sensitivity of 380 V/erg/cm$^2$. There was a slightly higher residual (ca. 110V) than in negative mode which may be attributed to trying to transport electrons through at least 17 microns (i.e. through 12 microns transport layer plus through the ca. 5 micron light penetration depth in the charge generation layer as well as across an interface). Even so, the result was surprisingly good at this total thickness and indicated reasonably good electron transport for the total device.

EXAMPLE V

A pigment dispersion was prepared by roll milling 6.3 grams of Type V hydroxygallium phthalocyanine pigment particles and 6.3 grams of poly(4,4'-diphenyl-1,1'-cyclohexane carbonate) binder (PcZ 200, available from Teijin Chemical, Ltd.) in 107.4 grams of tetrahydrofuran (THF) solvent with several hundred, about 700 to 800 grams, of 3 millimeter diameter steel or yttrium zirconium balls for about 2 to 72 hours. The dispersion millbase was diluted to 6 solid weight percent with the appropriate amount of THF solvent.

Separately, 2.79 grams of poly(4,4'-diphenyl-1,1'-cyclohexane carbonate) were weighed along with 2.10 grams of N,N'-bis-(3,4-dimethylphenyl)-4,4'-biphenyl amine, 0.90 gram of 4-n-butoxycarbonyl-9-fluorenylidene malononitrile, 17.08 grams of THF solvent and 3.60 grams of monochlorobenzene (MCB) solvent. This mixture was rolled in a glass bottle until the solids were dissolved then 3.53 grams of the above pigment dispersion were added to form the ambipolar charge generator coating solution containing the Type V hydroxygallium phthalocyanine pigment, poly(4,4'-diphenyl-1,1'-cyclohexane carbonate), N,N'-bis-(3,4-dimethylphenyl)-4,4'-biphenyl amine, and 4-n-butoxycarbonyl-9-fluorenylidene malononitrile in a solids weight ratio of (3:35:15:47) and a total solid content of 20 weight percent in an 85:15 weight ratio of THF:MCB solvent; and rolled to mix (without milling media).

Similarly, additional ambipolar charge generator layer solutions were prepared containing Type V hydroxygallium phthalocyanine pigment, poly(4,4'-diphenyl-1,1'-cyclohexane carbonate), N,N'-bis-(3,4-dimethylphenyl)-4,4'-biphenyl amine hole transport material (HTM), and 4-n-butoxycarbonyl-9-fluorenylidene malononitrile electron transporting material (ETM) in a solids weight ratio of (3:28:12:57) and a total solid content of 16 weight percent in an 85:15 weight ratio of THF:MCB solvent; Type V hydroxygallium phthalocyanine pigment, poly(4,4'-diphenyl-1,1'-cyclohexane carbonate), N,N'-bis-(3,4-dimethylphenyl)-4,4'-biphenyl amine hole transport material (HTM), and 4-n-butoxycarbonyl-9-fluorenylidene malononitrile in a solids weight ratio of (5:28:12:55), and a total solid content of 16 weight percent in an 85:15 weight ratio of THF:MCB solvent; and rolled to mix (without milling media). A typical charge generator layer was also prepared containing Type V hydroxygallium phthalocyanine pigment, poly(4,4'-diphenyl-1,1'-cyclohexane carbonate) in a solids weight ratio of (43:57) and a total solid content of 5.35 weight percent in an 85:15 weight ratio of THF:MCB solvent.

Separately, an ambipolar charge transport coating solution was prepared by dissolving 5.4 grams of N,N'-bis-(3,4-dimethylphenyl)-4,4'-biphenyl amine, 3.6 grams of 4-n-butoxycarbonyl-9-fluorenylidene malononitrile, 9 gams of PcZ-500 ($M_w$ ~50,000 available from Teijin Chemical, Ltd.) in 69.7 grams of THF solvent and 12.3 grams of monochlorobenzene (MCB) solvent. This mixture was rolled in a glass bottle until the solids were dissolved to form the bipolar charge transport coating solution containing N,N'-bis-(3,4-dimethylphenyl)-4,4'-biphenyl amine, 4-n-butoxycarbonyl-9-fluorenylidene malononitrile, PcZ-500 in a solids weight ratio of (30:20:50) and a total solid content of 18 weight percent in an 85:15 weight ratio of THF:MCB solvent.

The ambipolar charge generator dispersions were applied by a ring coating method directly to a bare aluminum substrate having a length of about 24 to about 36 centimeters and a diameter of 30 millimeters. For the 20 solid weight percent dispersion, a pull rate of about 50 millimeters/minute provided an approximately 9 micrometer thick ambipolar charge generator layer while for the 16 weight percent solutions a pull rate of about 80 millimeters/minute provided approximately 9 micrometer thick ambipolar charge generator layer, as determined by capacitive measurement after drying fifteen minutes at 120° C.

Subsequently, the ambipolar transport solution was applied directly over the ambipolar charge generator layer by the known ring coating method using a pull rate of about 120 millimeters/miute to form an approximately 13 micrometer thick ambipolar charge transport layer. The fully formed device was oven dried for 40 minutes at 120° C.

The first resulting member was comprised of a 13 micrometer thick ambipolar charge transport layer containing N,N'-bis-(3,4-dimethylphenyl)-4,4'-biphenyl amine, 4-n-butoxycarbonyl-9-fluorenylidene malononitrile, PCZ-500 polycarbonate in a solids weight ratio of (30:20:50), formed on top of a 9 μm CG 1 (photogenerating layer) containing Type V hydroxygallium phthalocyanine pigment, poly(4,4'-diphenyl-1,1'-cyclohexane carbonate), N,N'-bis-(3,4-dimethylphenyl)-4,4'-biphenyl amine hole transport material (HTM), and 4-n-butoxycarbonyl-9-fluorenylidene malononitrile electron transporting material (ETM) in a solids weight ratio of (3:28:12:57) formed directly on an aluminum supporting substrate.

The second resulting member was comprised of a 13 micrometer thick ambipolar charge transport layer containing N,N'-bis-(3,4-dimethylphenyl)-4,4'-biphenyl amine, 4-n-butoxycarbonyl-9-fluorenylidene malononitrile, PCZ-500 in a solids weight ratio of (30:20:50) formed on top of a 9 micrometer CG 2 containing Type V hydroxygallium phthalocyanine pigment, poly(4,4'-diphenyl-1,1'-cyclohexane carbonate), N,N'-bis-(3,4-dimethylphenyl)-4,4'-biphenyl amine, and 4-n-butoxycarbonyl-9-fluorenylidene malononitrile in a solids weight ratio of (3:35:15:47) formed directly on an aluminum substrate.

The third resulting member was comprised of a 13 micrometer thick ambipolar charge transport layer containing N,N'-bis-(3,4-dimethylphenyl)-4,4'-biphenyl amine, 4-n-butoxycarbonyl-9-fluorenylidene malononitrile, PCZ-500 in a solids weight ratio of (30:20:50), formed on top of a 9 micrometer CG 3 containing Type V hydroxygallium phthalocyanine pigment, poly(4,4'-diphenyl-1,1'-cyclohexane carbonate), N,N'-bis-(3,4-dimethylphenyl)-4,4'-biphenyl amine hole transport material (HTM), and 4-n-butoxycarbonyl-9-fluorenylidenemalononitrile in a solids weight ratio of (5:28:12:55) formed directly on an aluminum substrate.

The fourth resulting member prepared with a typical CGL was comprised of a 20 micrometer ambipolar charge transport layer containing N,N'-bis-(3,4-dimethylphenyl)-4,4'-biphenyl amine, 4-n-butoxycarbonyl-9-fluorenylidene malononitrile, PCZ-500 in a solids weight ratio of (30:20:50), on top of a 0.2 micrometer Typical CGL containing Type V hydroxygallium phthalocyanine pigment, poly(4,4'-diphenyl-1,1'-cyclohexane carbonate) in a solids weight ratio of (43:57), formed directly on an aluminum substrate.

Thicknesses (throughout the Examples) of the resulting dried layers were determined by capacitive measurement and transmission electron spectroscopy. The thick, ambipolar charge generation layer swelled to about 13 to about 15 micrometers after the 13 micrometer ambipolar charge transport layer was applied, yielding final total device thicknesses of about 30 micrometers.

The above devices were tested with a Xerox Corporation WorkCentre Pro 315XL printer/copier machine modified for high field testing using a development potential of −700 Vdc and a bias voltage of −600 Vdc. White page prints were made under controlled environment conditions of 80° C. and 80 percent relative humidity, and analyzed for black spot counts by scanning prints using a Umax Scanner and Optimus Analysis Software. The data obtained was reflected in the chart below. Note that the typical CGL coating directly on the bare aluminum tube had very high spot counts, while the spot counts for the ambipolar devices were low. The spot counts for the 3 weight percent pigment sample were reduced further where the transport matrix of hole and electron transporting component were increased to 50 weight percent. Although the 5 weight percent sample had higher spot counts, reducing the thickness of the charge generator can be expected to further reduce the spot counts.

| SAMPLE (Weight Ratio Pigment/Binder/HTM/ETM) | SPOT COUNT |
|---|---|
| Typical CG 60/40/0/0 | 19,345 |
| CG 1 3/57/28/12 | 1,969 |
| CG 2 3/47/35/15 | 584 |
| CG 3 5/55/28/12 | 3,234 |

The Examples above demonstrated, for example, the effect of widely distributing the pigment throughout a thicker layer that inhibits charge injection from the substrate without the use of a blocking layer into the photoreceptor which results in the corresponding decrease in blackspot printout. Similar samples prepared with the same solutions having thicker CG layers showed a slight increase in the blackspot count, however, no changes in overall print quality or density were observed.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive member comprised of a supporting substrate; a photogenerating layer comprised of a photogenerating component, a charge transport component, an electron transport component, and a polymer binder; and a charge transport layer comprised of a charge transport component, an electron transport component and a polymer binder.

2. A photoconductive member in accordance with claim 1 wherein said photogenerating layer is of a thickness of from about 5 to about 15 microns, and optionally wherein said member is bipolar.

3. A photoconductive member in accordance with claim 1 wherein the amount for each of said components in said photogenerating layer is from about 0.05 weight percent to about 30 weight percent for the photogenerating component, from about 10 weight percent to about 75 weight percent for the charge transport component, and from about 10 weight percent to about 75 weight percent for the electron transport component and wherein the total of said components is about 100 percent, and wherein said layer components are dispersed in from about 10 weight percent to about 75 weight percent of said polymer binder; and wherein the amounts for each of said components in said charge transport layer is from about 10 weight percent to about 75 weight percent for the charge transport component, and from about 10 weight percent to about 75 weight percent for the electron transport component, and wherein the total of said components is about 100 percent, and wherein said layer components are dispersed in from about 10 weight percent to about 75 weight percent of said polymer binder.

4. A photoconductive member in accordance with claim 1 wherein the amount for each of said components in the photogenerating layer mixture is from about 1 weight percent to about 5 weight percent for the photogenerating component; from about 20 weight percent to about 50 weight percent for the charge transport component; and from about 25 weight percent to about 75 weight percent for the electron transport component; and which components are contained in from about 25 weight percent to about 55 weight percent of a polymer binder.

5. A photoconductive member in accordance with claim 4 wherein the thickness of said photogenerating layer is from about 8 to about 35 microns, and the thickness of said charge transport layer is from about 8 to about 16 microns.

6. A photoconductive member in accordance with claim 1 wherein said charge transport component is comprised of hole transport molecules.

7. A photoconductive member in accordance with claim 5 wherein said charge transport component is comprised of hole transport molecules.

8. A photoconductive member in accordance with claim 1 wherein said photogenerating component absorbs light of a wavelength of from about 370 to about 950 nanometers.

9. A photoconductive member in accordance with claim 1 wherein the supporting substrate is comprised of a conductive substrate comprised of a metal.

10. A photoconductive member in accordance with claim 9 wherein the conductive substrate is aluminum, aluminized polyethylene terephihalate or titanized polyethylene terephthalate.

11. A photoconductive member in accordance with claim 1 wherein the binder for said photogenerating layer is selected from the group consisting of polyesters, polyvinyl butyrals, polycarbonates, polystyrene-b-polyvinyl pyridine, and polyvinyl formals.

12. A photoconductive member in accordance with claim 1 wherein said hole transport component for said photogenerating layer and wherein said charge transport layer comprises hole transport component, and wherein each of said hole transport are comprised of aryl amine molecules.

13. A photoconductive member in accordance with claim 12 wherein said hole transporting component or components is comprised of molecules of the formula

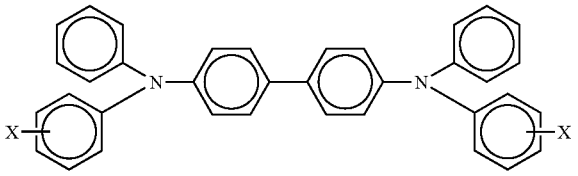

wherein X is selected from the group consisting of alkyl and halogen.

14. A photoconductive member in accordance with claim 13 wherein alkyl contains from about 1 to about 10 carbon atoms, and wherein the charge transport is an aryl amine encompassed by said formula.

15. A photoconductive member in accordance with claim 13 wherein alkyl contains from 1 to about 5 carbon atoms.

16. A photoconductive member in accordance with claim 13 wherein alkyl is methyl, and wherein halogen is chloride.

17. A photoconductive member in accordance with claim 13 wherein said hole transport is comprised of molecules of N,N'-diphenyl-N,N-bis(3-methyl phenyl)-1,1-biphenyl-4,4'-diamine.

18. A photoconductive member in accordance with claim 1 wherein said electron transport component for said photogenerating layer and said charge transport layer is (4-n-butoxycarbonyl-9-fluorenylidene) malononitrile, 2-methylthioethyl 9-dicyanomethylenefluorene-4-carboxylate, 2-(3-thienyl)ethyl 9-dicyanomethylene fluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone.

19. A photoconductive member in accordance with claim 1 wherein said electron transport component is (4-n-butoxycarbonyl-9-ftuorenylidene)malononitrile.

20. A photoconductive member in accordance with claim 13 wherein said electron transport component is (4-n-butoxycarbonyl-9-fluorenylidene)malononitrile, 2-methythioethyl 9-dicyanomethylenefluorene-4-carboxylate, 2-(3-thienyl)ethyl 9-dicyanomethylenefiuorene-4-carboxylate, 2-phenythioethyl 9-dicyanomethylenefluorene-4-carboxylate, 11,11,12,12, -tetracyano anthraquinodimethane or 1,3-dimethyl-10-(dicyanomethylene)-anthrone.

21. A photoconductive member in accordance with claim 1 further including in said photogenerating layer a second photogenerating component optionally comprised of a titanyl phthalocyanine, a metal phthalocyanine other than titanyl phthalocyanine, a perylene, trigonal selenium, or mixtures thereof.

22. A photoconductive member in accordance with claim 1 wherein said electron transport for said photogenerating layer and said charge transport layer is (4-n-butoxy carbonyl-9-fluorenylidene)malononitrile, and the charge transport for said layers is a hole transport of N,N'-diphenyl-N,N-bis (3-methyl phenyl)-1,1'-biphenyl-4,4"-diamine molecules.

23. A photoconductive member in accordance with claim 1 wherein said photogenerating layer component is a phthalocyanine with major peaks, as measured with an X-ray diffractometer, at Bragg angles (2 theta+/−0.2°).

24. A photoconductive member in accordance with claim 1 wherein said photogenerating component is a metal free phthalocyanine.

25. A method of imaging which comprises generating an electrostatic latent image on the imaging member of claim 1, developing the latent image, and transferring the developed electrostatic image to a suitable substrate.

26. A photoconductive member in accordance with claim 24 wherein said electron transport is (4-n-butoxycarbonyl-9-fluorenylidene)malononitrile, 2-methylthioethyl 9-dicyanomethylenefluorene-4-carboxylate.

27. A photoconductive member in accordance with claim 1 further containing an adhesive layer and a hole blocking layer.

28. A photoconductive member in accordance with claim 27 wherein said blocking layer is contained as a coating on a substrate, and wherein said adhesive layer is coated on said blocking layer.

29. A photoconductive member in accordance with claim 1 wherein said member comprises, in sequence, a supporting layer, said photogenerating layer and said charge transport layer, and wherein said electron transport is selected from the group consisting of N,N'-bis(1,2-dimethylpropyl)-1,4,5,8-naphthalenetetracarboxylic diimide represented by the formula

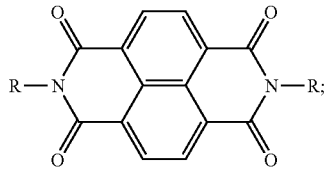

1,1'-dioxo-2-(4-methylphenyl)-6-phenyl-4-(dicyanomethylidene)thiopyran represented by the following structural formula

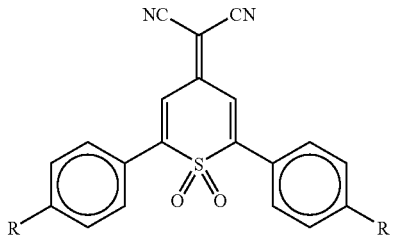

wherein R is independently selected from the group consisting of hydrogen, alkyl with 1 to about 4 carbon atoms, alkoxy with 1 to about 4 carbon atoms and halogen, and a quinone selected from the group consisting of carboxybenzylnaphthaquinone represented by the formula

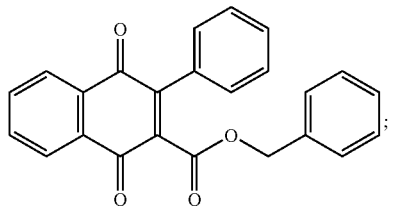

tetra(t-butyl) diphenolquinone represented by the following structural formula

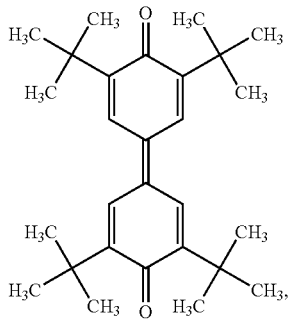

and mixtures thereof; and said binder is a film forming binder.

30. A photoconductive member in accordance with claim 29 wherein the charge transport component is the arylamine N,N'-diphenyl-N,N'-bis(3-methylphenyl)-[1,1'-biphenyl]-4,4'-diamine.

31. A photoconductive member in accordance with claim 29 wherein the film forming binder is a polycarbonate.

32. A photoconductive member in accordance with claim 1 wherein for the charge transport layer there is present about 42 weight percent of said charge transport component, about 28 weight percent of said electron transport component, and about 30 percent of binder; and wherein for said photogenerating layer there is present about 5 to about 10 weight percent of said photogenerating component, about 42 weight percent of said charge transport component, about 28 percent of said electron transport component and about 30 weight percent of binder.

33. A photoconductive member in accordance with claim 1 wherein for the charge transport layer there is present about 30 weight percent of said charge transport component, about 20 weight percent of said electron transport component, and about 50 percent of binder; and wherein for said photogenerating layer there is present about 5 to about 10 weight percent of said photogenerating component, about 42 weight percent of said charge transport component, about 29 percent of said electron transport component and about 30 weight percent of binder.

34. A photoconductive member in accordance with claim 1 wherein the member is free of a charge blocking layer between the supporting layer and the photogenerating layer, and wherein the member is free of any anti-plywood layer between the supporting layer and the photogenerating layer.

35. A photoconductive member in accordance with claim 1 wherein the binder is selected from the group consisting of polycarbonates, polystyrene-b-polyvinyl pyridine, N,N'-diphenyl-N,N'-bis(alkylphenyl)-1,1-biphenyl-4,4'-diamine, TTA, tri-p-tolylamine, AE-18, N,N'-bis-(3,4,-dimethyiphenyl)-4-biphenyl amine, AB-16, N,N'-bis-(4-methylphenyl)-N,N"-bis(4-ethylphenyl)-1,1'-3,3'-dimethylbiphenyi)-4,4'-diamine, and PHN, phenanthrene diamine.

36. A photoconductive member in accordance with claim 1 wherein the photogenerating component is an x-metal free phthalocyanine, a perylene, a chlorogallium phthalocyanine, a titanyl phthalocyanine, a hydroxygallium phthalocyanine, or mixtures thereof.

37. A photoconductive member in accordance with claim 1 wherein the photogenerating component is an x-metal free phthalocyanine, a perylene, a chlorogallium phthalocyanine, a titanyl phthalocyanine, or a hydroxygallium phthalocyanine.

38. A photoconductive member in accordance with claim 1 wherein the electron transport component for said photogenerating layer is N,N'-bis(1,2-dimethylpropyl)-1,4,5,8-naphthalenetetracarboxylic diimide, butoxy carbonyl fluorenylidene malononitrile, or 1,1'-dioxo-2-(4-methylphenyl)-6-phenyl-4-(dicyanomethylidene)thiopyran.

39. A photoconductive member in accordance with claim 1 wherein the electron transport component for said charge transport layer is N,N'-bis(1,2-dimethytpropyi)-1,4,5,8-naphthalenetetracarboxylic diimide, butoxy carbonyl fluorenylidene malononitrile, or 1,1'-dioxo-2-(4-methylphenyl)-6-phenyl-4-(dioyanomethylidene)thiopyran.

40. A photoconductive member in accordance with claim 1 wherein said electron transport is a carbonylfluorenone malononitrile of the formula

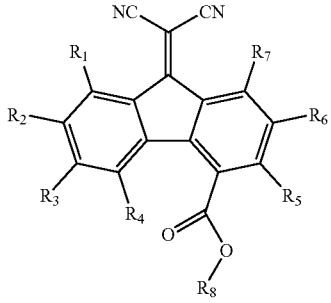

wherein each R is independently selected from the group consisting of hydrogen, alkyl, alkoxy, aryl, and halide; a nitrated fluorenone of the formula

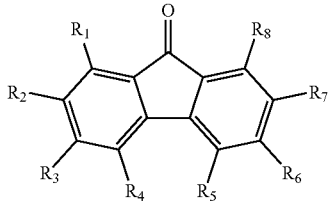

wherein each R is independently selected from the group consisting of alkyl, alkoxy, aryl, and halide, and wherein at least two R groups are nitro; a diimide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

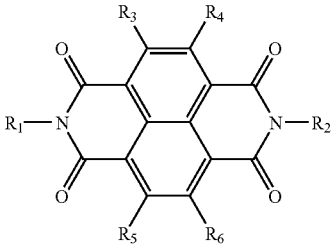

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

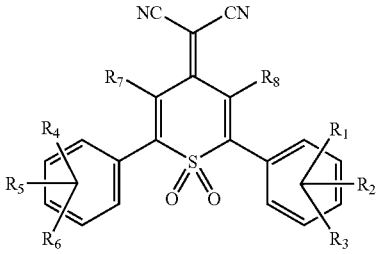

wherein each R is independently selected from the group consisting of hydrogen, alkyl, alkoxy, aryl, and halide; a carboxybenzylnaphthaquinone of the alternative formulas

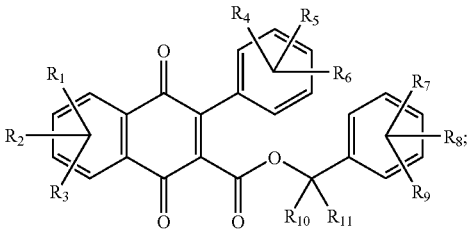

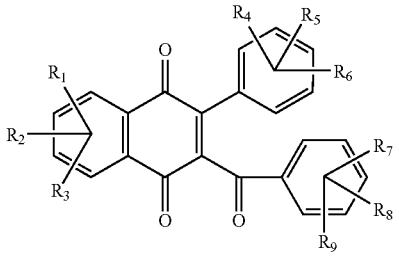

wherein each R is independently selected from the group consisting of hydrogen, alkyl, alkoxy, aryl, and halide; and a diphenoquinone of the formula

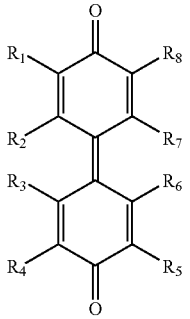

wherein each R is independently selected from the group consisting of hydrogen, alkyl, alkoxy, aryl, and halide.

41. A photoconductive imaging member comprised of a supporting substrate; a photogenerating layer comprised of a photogenerating component, a charge transport component, an electron transport component, and a polymer binder; and a charge transport layer comprised of a charge transport component, an electron transport component and a polymer binder.

42. A photoconductive imaging member comprised of a supporting substrate; a photogenerating layer comprised of a photogenerating component, a charge transport component, an electron transport component, and a polymer binder; and a charge transport layer comprised of a charge transport component, an electron transport component and a polymer binder; and wherein said electron transport is comprised of at least one of a carbonylfluorenone malononitrile of the formula

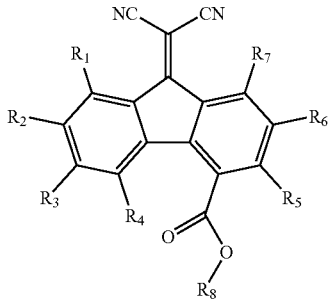

wherein each R is independently selected from the group consisting of hydrogen, alkyl, alkoxy, aryl, and halide; a nitrated fluorenone of the formula

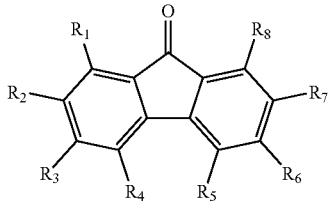

wherein each R is independently selected from the group consisting of alkyl, alkoxy, aryl, and halide, and wherein at least two R groups are nitro; a dilmide selected from the group consisting of N,N'-bis(dialkyl)-1,4,5,8-naphthalenetetracarboxylic diimide and N,N'-bis(diaryl)-1,4,5,8-naphthalenetetracarboxylic diimide represented by the formula

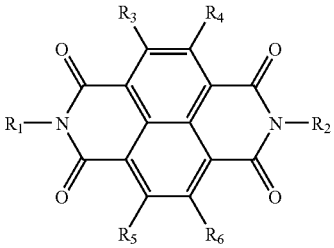

wherein $R_1$ is alkyl, alkoxy, cycloalkyl, halide, or aryl; $R_2$ is alkyl, alkoxy, cycloalkyl, or aryl; $R_3$ to $R_6$ are as illustrated herein with respect to $R_1$ and $R_2$; a 1,1'-dioxo-2-(aryl)-6-phenyl-4-(dicyanomethylidene)thiopyran of the formula

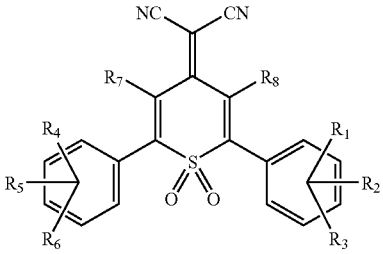

wherein each R is independently selected from the group consisting of hydrogen, alkyl, alkoxy, aryl, and halide; a carboxybenzylnaphthaquinone of the alternative formulas

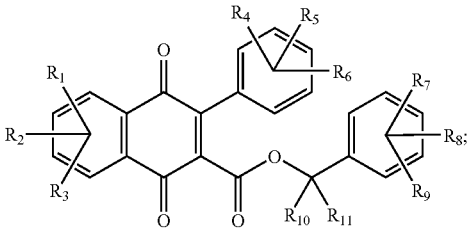

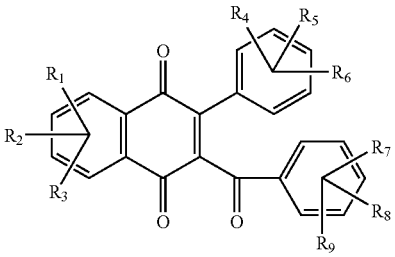

wherein each R is independently selected from the group consisting of hydrogen, alkyl, alkoxy, aryl, and halide; and a diphenoquinone of the formula

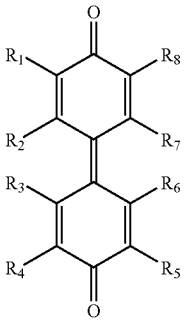

wherein each R is independently selected from the group consisting of hydrogen, alkyl, alkoxy, aryl, and halide.

43. A photoconductive member in accordance with claim 1 wherein said photogenerating layer further contains a polymer binder.

44. A photoconductive member in accordance with claim 1 wherein said photogenerating layer further contains a polymer binder of a polycarbonate.

45. A photoconductor comprised of an optional supporting substrate; a photogenerating layer comprised of a photogenerating pigment, hole transport molecules, an electron transport compound, and a polymeric binder; and a hole transport layer comprised of hole transport molecules, an electron transport compound, and a polymeric binder.

* * * * *